United States Patent [19]

Taplin

[11] 4,250,857

[45] Feb. 17, 1981

[54] FUEL INJECTOR FOR PRODUCING SHAPED INJECTION PULSES

[75] Inventor: Lael B. Taplin, Bloomfield Hills, Mich.

[73] Assignee: The Bendix Corporation, Southfield, Mich.

[21] Appl. No.: 942,020

[22] Filed: Sep. 13, 1978

[51] Int. Cl.[3] ..... F02M 39/02

[52] U.S. Cl. ..... 123/448; 239/533.5; 123/496

[58] Field of Search ..... 123/139 AT, 139 AS, 123/139 AQ, 139 AF, 139 AY, 32 JV, 140 FP, 140 FG; 239/533.4, 533.5; 417/206

[56] References Cited

U.S. PATENT DOCUMENTS

| | | | |
|---|---|---|---|
| 1,834,061 | 12/1931 | Joachim | 239/533.4 |
| 1,974,851 | 9/1934 | Hurst | 123/139 AF |
| 2,065,272 | 12/1936 | Filehr | 123/139 AT |
| 3,747,857 | 7/1973 | Fenne | 239/533.5 |
| 3,817,456 | 6/1974 | Schlappkohl | 239/533.5 |
| 4,108,383 | 8/1978 | Thoma | 239/533.5 |

FOREIGN PATENT DOCUMENTS

| | | | |
|---|---|---|---|
| 1041940 | 6/1953 | France | 239/533.5 |

OTHER PUBLICATIONS

"Internal Pintle Nozzle", by H. E. Woodward, Oil Engine and Gas Turbine, Sep. 1964, 34.

*Primary Examiner*—P. S. Lall

*Attorney, Agent, or Firm*—Markell Seitzman; Russel C. Wells

[57] ABSTRACT

A fuel injector, especially adapted for diesel engines, produces a fuel injection pulse having a predetermined time-variable flow rate. Preferably the injection pulse is ramp-shaped which approximates a linear function of time. A pressure chamber receives fuel at a substantially constant flow rate and an injection valve connected therewith opens in response to the pressure in the pressure chamber for delivering a fuel injection pulse to the combustion chamber. Means for absorbing a fluid pulse, in the form of an absorption chamber and flow restrictor, is connected with the pressure chamber to accept a ramp-shaped absorption pulse which is inversely related to the injection pulse. The fuel flow rate into the pressure chamber varies directly with engine speed and the injection pulse has a slope and amplitude which vary directly with engine speed; the absorbing means is provided with time constant adjusting means responsive to speed of operation so that the slope and amplitude of the absorption pulse vary directly with engine speed.

44 Claims, 18 Drawing Figures

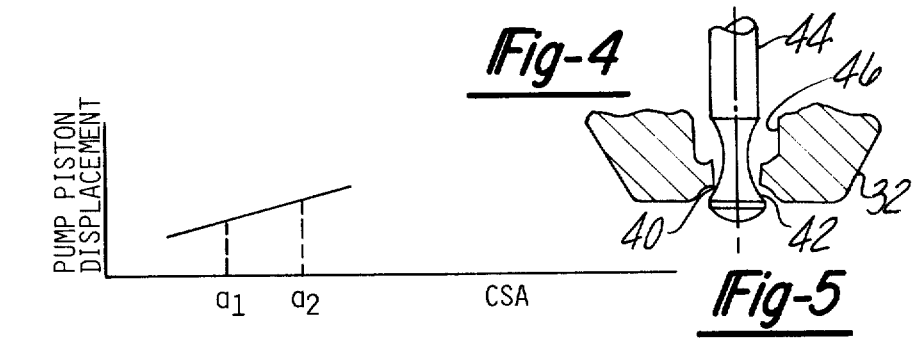
Fig-4
Fig-5
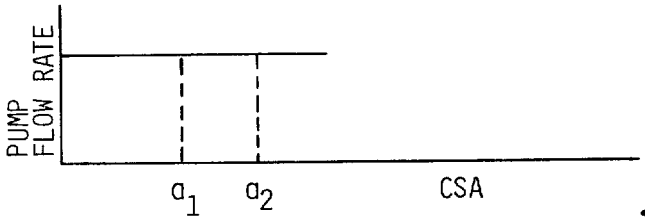
Fig-6
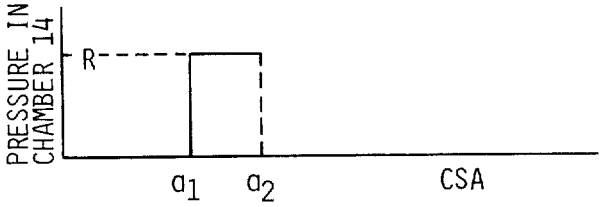
Fig-7
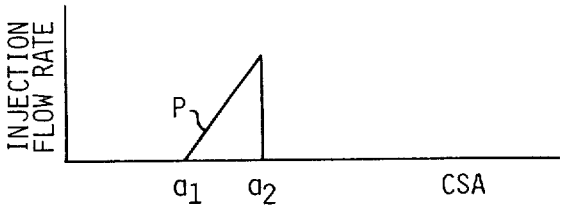
Fig-8
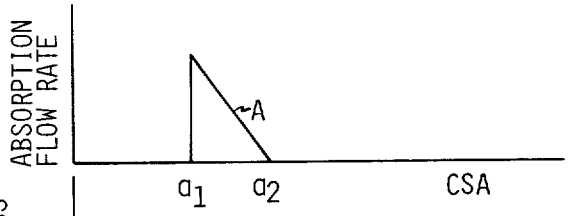
Fig-9
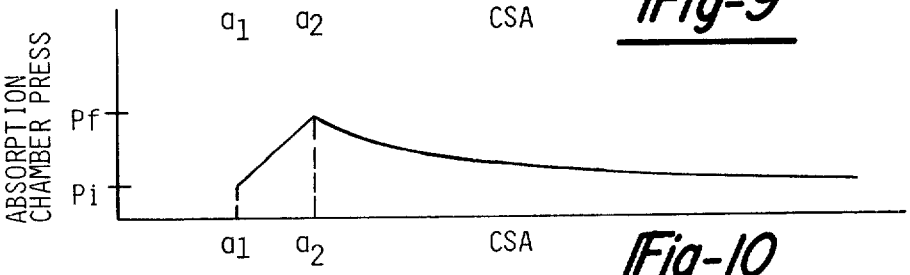
Fig-10

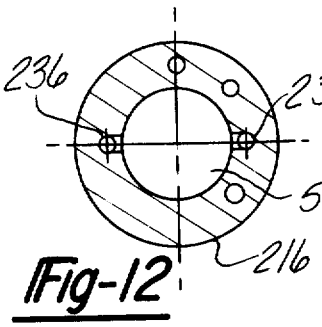
Fig-12
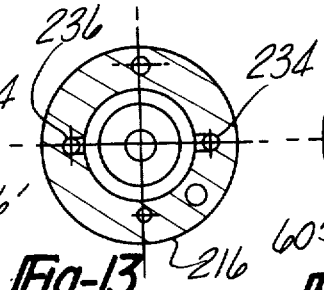
Fig-13
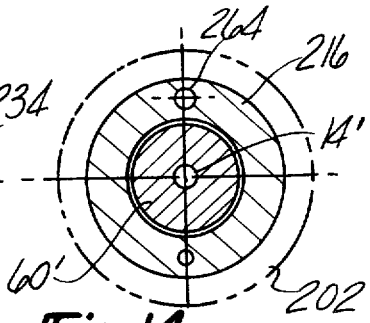
Fig-14
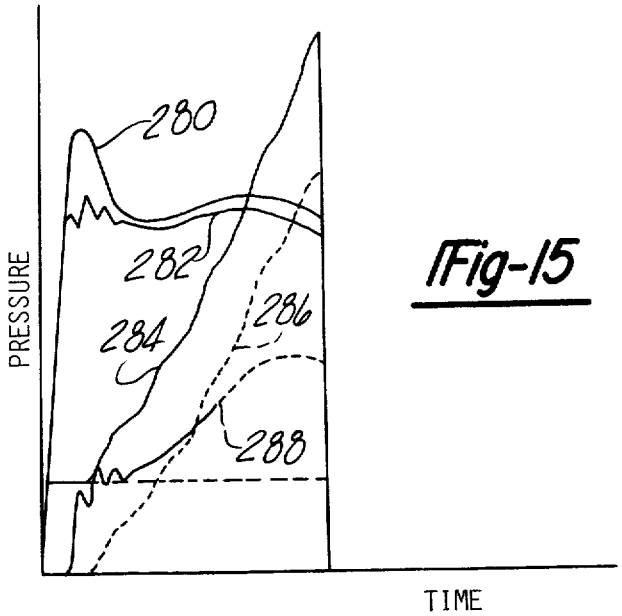
Fig-15
Fig-16
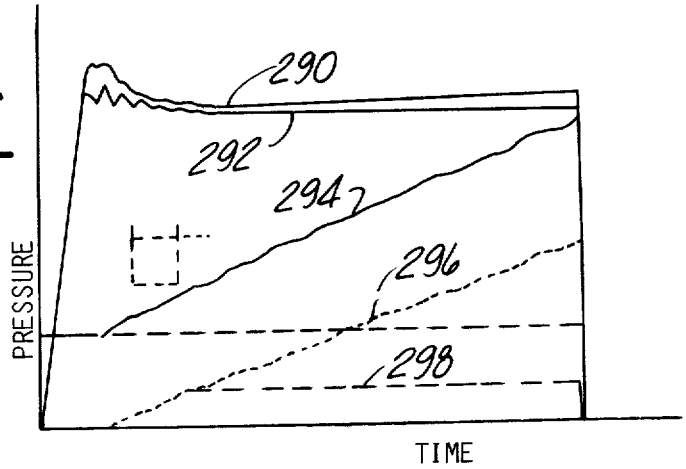

FUEL INJECTOR FOR PRODUCING SHAPED INJECTION PULSES

TECHNICAL FIELD

This invention relates to fuel injection devices for internal combustion engines; more particularly, it relates to a fuel injector for compression ignition or diesel engines.

BACKGROUND ART

In diesel engines, the injection of fuel into the combustion chamber is produced in a very short time interval. In general, the fuel injection occurs as a pulse having a duration of a few milliseconds, with a typical duration of about one millisecond for a four cylinder, four cycle engine operating at full speed. Thus, the duration of the injection pulse is short compared with the duration of one crankshaft revolution. In the prior art, the timing of the injection pulse, i.e. the crankshaft angle at which it is initiated, is controlled in accordance with engine operating parameters. Also, the quantity of fuel in each injection pulse is controlled according to engine operating parameters. In order to further enhance engine performance, there remains a need for further control of the injection pulse, namely, the control of the pulse shape. Heretofore, the shape of the fuel pulse, i.e. the fuel flow rate as a function of time, has not been correlated in a controlled manner with engine operating conditions.

In the idealized diesel engine cycle, combustion occurs at constant pressure, i.e. there is a constant pressure burning of the fuel. It is known that so-called constant pressure burn can be achieved by providing fuel injection in which the flow rate of fuel increases linearly with time. Accordingly, it is desirable to produce injection pulses which are of ramp shape. Further, it is desirable to cause the slope of the fuel pulse ramp i.e. the flow ramp rate, to increase with engine speed according to a predetermined relationship.

DISCLOSURE OF THE INVENTION

In accordance with this invention, a fuel injector for an internal combustion engine is provided which produces an injection fuel pulse which has a predetermined time-variable flow rate. This is accomplished by a pressure chamber for receiving fuel at a predetermined flow rate and an injection valve which opens in response to pressure in the pressure chamber for delivering an injection fuel pulse to the combustion chamber and a fluid pulse absorbing means in communication with the pressure chamber to absorb a time variable flow rate of fuel for modifying the time rate of change of flow through the injection valve. Preferably, the absorbing means includes an absorption chamber and a flow restrictor connected between the pressure chamber and the absorption chamber.

Further, in accordance with this invention, the time rate of change and the amplitude of the fuel injection pulse is increased with increasing speed of operation of the injector and hence engine speed. This is accomplished by means connected with the absorbing means for changing its time constant as a function of speed of operation of the injector. In a preferred embodiment, fluid discharge time constant means are connected with the absorption chamber to preset the pressure in the absorption chamber according to speed of operation prior to each injection cycle.

Further, in accordance with this invention, a fuel injector is provided which produces a fuel pulse having a ramp-shaped flow rate which is an approximate linear function of time. This is accomplished by an injector comprising a pump which delivers a predetermined flow rate to a pressure chamber, means for correlating the pressure in said chamber and the actuation of the injection valve so that the metering orifice increases at a rate which produces a ramp flow rate, and means for absorbing a complementary or inverse flow rate from the pump which when added to the injection flow rate is equal to the pump flow rate. Preferably, a cam pump provides a constant flow rate and means are provided to maintain a substantially constant pressure in the pressure chamber and the injection valve is opened so that the product of the velocity of valve opening and the valve orifice area is a linear function of time to produce a flow rate which increases linearly with time and the flow absorbing means takes up a flow rate which is the inverse function of the flow rate through the injection valve.

Further, in accordance with the invention, an injector is provided which produces fuel injection pulses with a ramp flow rate required to produce a constant pressure burn. According to the invention, the ramp slope and the maximum amplitude of the fuel pulses are increased with engine speed in such a manner that the same fuel quantity is delivered to the combustion chamber over the speed range of the engine. This is accomplished by providing a pump for delivering fuel at a flow rate which is constant for a given engine speed and which increases linearly with engine speed and means for operating the injection valve to produce an injection pulse having a ramp flow rate with a ramp slope and amplitude which increases with flow rate from the pump, and flow absorption means which absorbs a ramp flow rate having an inverse slope and amplitude which increase with engine speed.

Further, in accordance with this invention, a fuel injector is provided which provides a ramp-shaped fuel injection pulse and an inverse ramp-shaped fuel absorption pulse with the slope of the respective ramps being adjusted or preset for each succeeding engine cycle in accordance with engine speed. The inverse ramp-shaped absorption pulse is produced by an absorption chamber with control means for presetting the flow rate into the absorption chamber for each injection cycle. Further, according to the invention, the control means comprises a time constant means for adjusting said flow rate into the absorption chamber.

Further, in accordance with the invention a controlled degree of atomization of the fuel is achieved at the injection valve while providing a ramp flow rate. This is accomplished by regulating means for maintaining a substantialy constant pressure drop across the injection valve.

A preferred embodiment of the invention is adapted for variable speed engines and the slope of the ramp flow rate is varied with engine speed. Preferably, this is accomplished by an absorption chamber provided with a restricted discharge passage which allows the pressure in the chamber to decrease from an initial value to a final value as a function of time; accordingly, the final value is a function of the time interval between injection pulses which in turn depends upon engine speed. Thus, the initial value of pressure in the absorption chamber for an injection cycle is determined by the final value attained in the preceding cycle and the time between cycles. In this manner, the initial pressure value is preset according to engine speed and this preset value determines the ramp rate or slope of the pulse which is absorbed by the chamber.

In an alternate embodiment for varying the ramp flow rate with engine speed, an absorption chamber is provided together with means for increasing the flow rate to the absorption chamber as speed increases and means for increasing the speed of the actuating means as engine speed increases. In one embodiment, this is accomplished by an absorption chamber having a fixed volume and a flow control valve actuated by speed responsive means for admitting flow to the absorption chamber together with a variable volume storage chamber for supplying fluid pressure to a hydraulic piston actuator for the injection valve and speed responsive means for adjusting the volume of the storage chamber. In an alternative embodiment, an adjustable volume storage chamber is provided and an adjustable volume absorption chamer is provided with speed responsive means for adjusting the volumes of both chambers.

A more complete understanding of this invention may be obtained from the detailed description that follows taken with the accompanying drawings.

BRIEF DESCRIPTION OF DRAWINGS

FIG. 4 shows a detail of construction;

FIG. 5 is a graph of a pump characteristic;

FIG. 6 is a graph of pump flow rate;

FIG. 7 shows a regulated pressure in the injector;

FIG. 8 shows the injection valve flow rate;

FIG. 9 shows the absorption chamber flow rate;

FIG. 10 shows the pressure variation in the absorption chamber;

FIG. 12 is a view taken on lines 12—12 of FIG. 11;

FIG. 13 is a view taken on lines 13—13 of FIG. 11;

FIG. 14 is a view taken on lines 14—14 of FIG. 11;

FIGS. 15 and 16 are graphical representations of the performance of an injector;

BEST MODE FOR CARRYING OUT THE INVENTION

Figure 1:
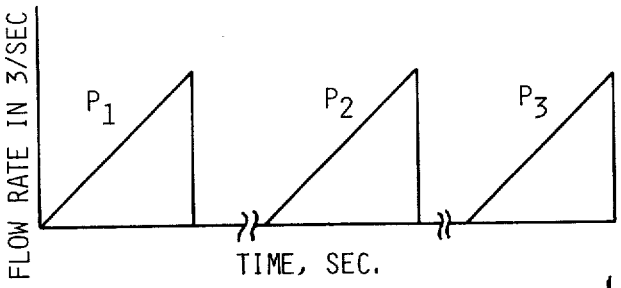
FIG. 1 is a graph showing the injection flow rate as a function of time.

Referring now to the drawings, there is shown an illustrative embodiment of the invention in a fuel injector unit of an injection system especially adapted for a diesel engine. The fuel injection system comprises an injector unit, as set forth herein, for each cylinder of the engine. As is well understood, the injector is adapted for mounting in the cylinder head of the engine with the injection valve opening directly into the combustion chamber of the respective cylinder.

In the diesel cycle, the gas in the combustion chamber undergoes adiabatic compression during the compression stroke of the piston and then upon the occurrence of compression ignition the gas is burned at constant pressure to initiate the power stroke of the piston. After the combustion at constant pressure the gas is adiabatically expanded during the power stroke and then it is exhausted from the cylinder at constant volume in preparation for the next cycle. The constant pressure combustion is achieved by providing an injection of fuel in which the flow rate of fuel increases linearly with time. The desired flow rate characteristic is depicted in the graph of FIG. 1. The flow rate, expressed in terms of volume per unit time, is shown as a substantially linear function of time. The graph of FIG. 1 represents a sequence of injection pulses $P_1$, $P_2$ and $P_3$. Each pulse is initiated at the appropriate crankshaft angle for the associated cylinder and typically has a duration ranging from 0.1 ms. up to one or two ms. The injection pulse for a given engine cylinder is repeated for every two crankshaft revolutions.

Figure 2:
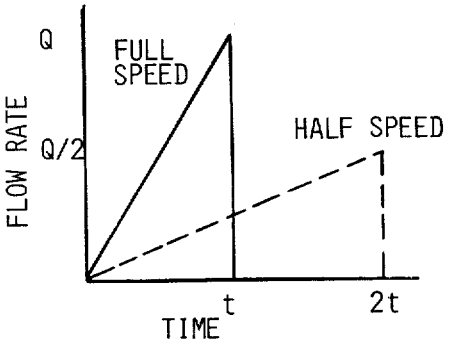
FIG. 2 is a graph of flow rate for different engine speeds.

For a variable speed engine, it is necessary to inject the same volume of fuel at different speeds of the engine, if the same engine torque is to be maintained. The volume of fuel in an injection pulse P is represented by the area under the ramp-shaped pulse. Accordingly, the slope and the amplitude of the ramp-shaped pulse must increase with engine speed. This relationship is depicted in FIG. 2 wherein the injection pulse for full speed has twice the amplitude and one-half the time duration as the injection pulse for half-speed of the engine.

Figure 3:
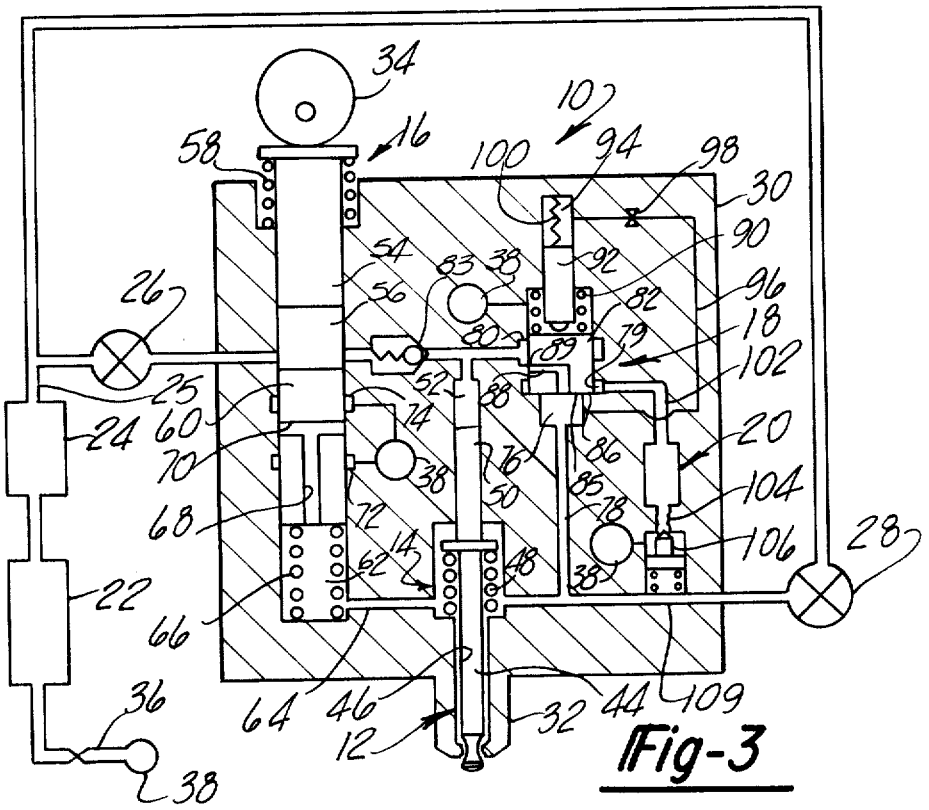
FIG. 3 shows the injector of the present invention.

A preferred embodiment of the fuel injector unit of this invention is shown diagrammatically in FIG. 3. The injector 10, in general, comprises an injection valve 12 which is supplied with fuel from a pressure chamber 14. A high pressure pump 16 pressurizes the fuel in the chamber 14 causing fuel flow to a relief valve 18 and a flow absorption chamber 20. The injector 10 is supplied with fuel from a tank 22 by a low pressure supply or transfer pump 24. The outlet of the pump 24 is connected through a supply conduit 25 to a solenoid timing valve 26 to the chamber of high pressure pump 16. It is also connected through a solenoid metering valve 28 to the pressure chamber 14. In general, the metering valve 28 is opened for a predetermined time interval prior to each injection cycle to supply a predetermined quantity of fuel for the injection. The timing valve 26 is also opened during the same time interval. After the predetermined time interval, the metering valve is closed. The timing valve remains open until a predetermined crankshaft angle and then it is closed to initiate injection. Injection is terminated by operation of the injector, as will be described subsequently.

The injector 10 has an injector body 30 formed with a nozzle 32 which is adapted to be threadedly received in the cylinder head of the engine, in a conventional manner. The pump 16 is driven by an engine cam shaft and includes a pump cam 34 which is driven in synchronism with the engine crankshaft. One other external connection to the injector 10 is a fuel return conduit 36 which is connected with the tank 22. The fuel return conduit is also connected with the injector body 30. A common connection of the fuel return conduit or line 36 with several passages in the injector body 30 is represented by a symbol 38.

The injection valve 12 is a poppet valve which is operatively disposed in the nozzle 32. The poppet valve, as shown in the enlarged view of FIG. 4 comprises a valve seating element 40 formed on the nozzle 32 and a valve closure element 42 formed on the lower end of a valve actuating element or stem 44. The valve seating element 40 and closure element 42 coact to define a valve orifice for metering the flow of fuel from the pressure chamber 14 to the combustion chamber. The valve orifice is closed with the valve stem 44 in its uppermost limit of travel with the closure element 42 seated against the seating element 40. The valve orifice is opened by downward movement of the stem 44 and the cross-sectional area of the orifice increases as a linear function of displacement of the valve stem 44. The valve stem 44 extends through a flow passage 46 into the pressure chamber 14. Actuation of the poppet valve 12 toward the closed position is provided by a bias spring 48 which acts against an enlarged shoulder on the stem 44. Actuation of the poppet valve toward the open position provided by a hydraulic piston 50 which extends upwardly from the stem 44 into an actuator chamber 52. The actuator chamber 52 is supplied with fuel under controlled pressure by means which will be described presently.

The pump 16 comprises a pump piston 5 which is disposed in a pump chamber 56. The pump piston is provided with a return spring 58 and is actuated on the compression stroke by the cam 34. The cam 34 is a constant lift cam which causes piston displacement which is a linear function of cam shaft rotation.

A metering piston 60 is disposed in communication with the pump chamber 56 and is urged downwardly by the fuel pressure in the pump chamber. The metering piston 60, at its lower end, is movably disposed in a metering chamber 62 which is connected by a passage 64 with the pressure chamber 14. The metering piston 60 is urged in the upward direction by a return spring 66. The metering piston 60 is provided with an axial passage 68 which extends from the lower end of the piston to a transverse passage 70. (The passage 68 may extend axially through the piston and be provided with a damper orifice with or without a check valve.) A lower discharge passage 72, of annular shape, is provided in the chamber 62 and connected with the fuel return line 38. An upper discharge passage 74 is also connected with the fuel return line 38. The passage 70 in the metering piston coacts with the discharge passage 72 at the lower end of its stroke to relieve the pressure in the metering chamber and it coacts with the discharge passage 74 at the upper end of its stroke to relieve the pressure in the metering chamber.

The relief valve 18 serves dual functions; firstly, it relieves pressure from pressure chamber 14 into the absorption chamber 20 at a predetermined value of pressure and secondly, it regulates fuel pressure in the actuating chamber 52. The relief valve 18 has an inlet chamber 76 which is connected through a passage 78 with the pressure chamber 14. An annular outlet passage 79 is connected with the absorption chamber 20 and an annular outlet passage 80 is connected with the actuator chamber 52. The outlet passage 80 is also connected through a check valve 83 with the pump chamber 56. The relief valve comprises a valve spool 82 having its lower end communicating with the inlet chamber 76 and being movable upwardly against valve bias means by a predetermined value of pressure in the chamber 76. The valve spool 82 coacts at its lower end 84 with a valve seat 86 to provide an orifice 85 connecting the inlet chamber 76 with the outlet chamber 79. The valve spool 82 is provided with a passage 88 which extends from the inlet chamber 76 to a lateral port on the spool 82 which coacts with the discharge passage 80 to form a regulating orifice 89 which connects the inlet chamber 76 with the outlet chamber 80. The spool 82 is biased toward the closed position by a bias spring 90. With the valve spool in its lower position the orifices 85 and 89 are both closed.

In order to provide the pressure relief valve 18 with a fast response and a high value of gain, it is preferably a differential area type valve. For this purpose, the bias means for the spool 82 includes a piston 92 movable in a cylinder 94 against the upper end of the spool 82. The cylinder 94 is connected with the inlet chamber 76 through a passage 96 which includes a flow restrictor 98. A spring 100 urges the piston 92 against the valve spool 82. When the fuel pressure in the inlet chamber 76 of the pressure relief valve reaches a predetermined value the spool 82 is accelerated rapidly against the resistance of the bias spring 90 and the bias spring 100 as a result of the fuel pressure acting on the relatively large area of the lower end of the spool 82. Initially, the fuel pressure acting on the piston 92 is small since the cylinder 94 cannot be pressurized instantly through the restrictor 98. Accordingly, a transient or step change in pressure occurs across the spool 82 and the relief valve is opened rapidly. The fuel contained in the cylinder 94 acts as a fluid spring in parallel with the mechanical spring 100 and the combination of the two springs increases the natural frequency of the relief valve to a value much higher than that which can be achieved with a mechanical spring alone. Thus, the relief valve is opened instantaneously and, as will be described below, it is immediately operative in a regulating mode to maintain the pressure in pressure chamber 14 at a constant value.

The absorption chamber 20 is connected with the relief valve 18 at the discharge passage 79 through a passage 102. The absorption chamber is connected through a flow restrictor 104, preferably in the form of multiple orifices in series, and through a check valve 106 with the return line 38. (The flow restrictor may be a vortex diode, if desired.) The check valve 106 is biased closed by a spring 107 and the fluid pressure in the pressure chamber 114 through a passage 109.

The operation of the injector of FIG. 3 will now be described with reference to FIGS. 5 through 10. The pump piston 54 is displaced as a linear function of crankshaft angle by rotation of the cam 34. The pump piston displacement as a function of crankshaft angle is depicted in FIG. 5. The downward stroke of the pump piston 54 commences at a predetermined crankshaft angle and continues throughout that portion of the crankshaft displacement during which fuel injection will be required. The pump flow rate is constant throughout the downward stroke of the piston 54, as depicted in FIG. 6.

Injection is initiated by closure of the timing valve 26 (metering valve 28 is already closed following the metering portion of the cycle prior to injection). The timing valve 26 and the metering valve 28 are controlled in a known manner by an electronic control unit in accordance with engine operating parameters. With the timing valve 26 being closed to initiate injection at a crankshaft angle $a_1$, the pressure in the pump chamber 56 increases substantially instantaneously since the flow rate from the pump is at a constant value at this time. The continued displacement of the pump piston compresses the fuel in chamber 56 and the metering piston 60 begins to move downwardly against the reaction of the return spring 66. Accordingly, the fuel pressure in metering chamber 62 and the pressure chamber 14 increases substantially instantaneously as shown in FIG. 7. The pressure rises to a predetermined value R which is equal to the pressure at which the relief valve 18 is set to open. By reason of the regulating action, which will be explained presently, the pressure in chamber 14 is maintained substantially constant at the value R during fuel injection. It is noted that the downward travel of the metering piston 60 continues during injection; when the passage 70 becomes aligned with the discharge passage 72, the pressure in the pump chamber 56 is relieved and the downward travel of the metering piston is allowed to stop. In normal operation the metering piston reaches the position to relieve the pump pressure before the timing valve 26 and the metering valve 28 are opened by the electronic control unit. Hence, the injection is terminated by hydrodynamic operation, at a crankshaft angle $a_2$ and hence the response time of the solenoids is not critical.

In order to achieve the desired ramp-shaped fuel pulses, as discussed with reference to FIG. 1, the pressure in pressure chamber 14 and the rate of movement of the poppet valve 12 are controlled. The control action is such that the pressure is maintained at a constant value and the poppet valve is opened at a velocity such that the product of velocity and the area of the poppet valve orifice is a linear function of time. As described above, the area of the orifice of the popper valve increases linearly with displacement of the valve closure element 42 and hence the valve stem 44. Accordingly, the actuating means for the poppet valve 12 are adapted to impart opening motion at a constant velocity.

The actuation of the poppet valve in a manner to attain the desired constant velocity is provided by the action of the relief valve 18 which also opens the flow passage to the absorption chamber 20. When the relief valve 18 cracks or opens at the pressure R, as described above, a flow of fuel commences from the pressure chamber 14 through the passage 78 and the orifice 85 to the absorption chamber 20. The flow of fuel into the absorption chamber will be described presently; for the time being, the regulating function of the relief valve 18 will be described. Also, when the relief valve 18 opens fuel commences to flow from the pressure chamber 14 to the passage 78 and the orifice 89 to the actuator chamber 52. The relief valve acts as a regulating valve under the influence of the fuel pressure acting on the lower end of the spool 82 and the combined forces of the bias spring 90 and the piston 92 acting on the upper end. The regulating orifice 89 is adjusted so that the pressure in the pressure chamber 14 maintains a constant value. When the pressure in the pressure chamber 14 tends to change, the orifice 89 and the pressure in the actuator chamber 52 is changed accordingly. This causes a change in the velocity of the actuator piston 50 and hence the opening of the poppet valve with the effect of holding the pressure in the chamber 14 at a constant value. The fuel pressure is thus maintained in chamber 14 at the value R during fuel injection, as depicted in FIG. 7.

With the constant pressure in the pressure chamber 14 and the constant velocity of opening of the poppet valve 12, as described above, a ramp-shaped fuel pulse P is produced, as shown in FIG. 8. Since the fuel flow out of the poppet valve 12 is an increasing linear function of time during injection and the pump delivers a constant value of flow rate to the pressure chamber 14, there is an excess of flow into the pressure chamber 14 which must be taken up or absorbed by other means, namely the absorption chamber 20. A time-variable flow rate is to be taken up which is an inverse function or the complement of the ramp-shaped injection pulse P. In other words, an absorption pulse is required which is a decreasing linear function of the crankshaft angle during injection. Such an absorption pulse A is shown in FIG. 9, it being noted that the summation of the injection pulse P and the absorption pulse A is substantially equal in flow rate at all times to the pump flow rate of FIG. 6. The absorption chamber 20 is of such volume and pressure that it produces the absorption pulse A which is the inverse of the injection pulse P, as will be described below.

The absorption chamber 20 functions as a time constant flow path element and absorbs a fluid pulse by fluid compression, with a time constant characteristic analogous to that of an electrical capacitor absorbing a current pulse. The ramp-shaped pulse is actually exponential but over the time period of interest it is substantially linear. It is noted that the absorption pulse A has a duration of around 1 or 2 milliseconds, the same as the injection pulse P, and at the end of injection at the crankshaft angle $a_2$ the pressure in the pressure chamber 14 drops to a low value and the relief valve 18 closes. During the absorption pulse A the pressure in the absorption chamber 20 increases from an initial value $P_1$ to a final value $P_f$, as shown in FIG. 10. The relief valve is closed with the pressure in the absorption chamber 20 at the final value $P_f$. In order to reset the absorption chamber 20 for the next injection cycle, it is necessary to relieve the pressure in the chamber. This is done by the flow restrictor 104 which allows the pressure in the absorption chamber 20 to decrease as a function of time, as indicated in FIG. 10. The discharge time constant of the pressure chamber 20 and the flow restrictor 104 is much greater than the charging time constant of the absorption chamber 20, as represented in FIG. 10. After the injection pulse is terminated at crankshaft angle $a_2$, the pressure in the absorption chamber diminishes from the final pressure value $P_f$ during the interval between injection pulses to an initial pressure value $P_i$ for the next injection pulse. The value of the initial pressure $P_i$ will depend upon the time interval between injection pulses and hence it is a function of engine speed. At high engine speeds the value of the initial pressure in the absorption chamber will be relatively high and at low engine speeds it will be relatively low. The initial pressure $P_i$ in the absorption chamber determines the rate at which fluid flow will be absorbed by the adsorption chamber. Thus at a high initial pressure the flow rate of absorption will decrease rapidly and at a low initial pressure the flow rate will decrease more slowly. In other words, the value of the initial pressure $P_i$ in the absorption chamber establishes the time constant or the slope of the ramp-shaped absorption pulse.

In operation of the injector with a variable speed engine, the ramp rate of the injection pulse is adjusted with engine speed while maintaining constant pressure of injection. As the engine speed increases, the flow rate from the pump 16 increases and the injection pulse duration decreases. The pressure relief valve 18 operates in the manner described above to regulate the pressure in pressure chamber 14 at a constant value. However, because of the increased flow rate into the pressure chamber 14 at higher speeds, the poppet valve will be opened at higher velocity to maintain the pressure in the pressure chamber. Thus, the ramp rate of injection pulse P is increased with speed. At the increased speed, there is less time interval between injection pulses and consequently the initial pressure value $P_i$ in the absorption chamber 20 will be held at a value higher than that for lower speed. Consequently, the ramp rate for the absorption pulse A will be increased. In the change from full speed to half speed, for example, there is a very large difference in the value of the final pressure $P_f$. It is this large difference which produces a large change in the slope of the flow rate. A two-to-one speed change produces a four-to-one slope change in the flow through the injector poppet valve and the same relationship is obtained in the absorption flow to the absorption chamber. Accordingly, the same quantity of fuel is injected in each pulse by the injector in operation at different speeds.

The injector is reset for the next injection pulse in the following manner. The termination of an injection pulse occurs when the metering piston 60 has moved downwardly to the point where the passage 70 is aligned with the discharge passage 72. This results in an immediate reduction of the pressure in the pressure chamber 14 and the poppet valve 12 and the relief valve 18 are immediately closed. Then the timing valve 26 and the metering valve 28 are opened under the control of the electronic control unit. Fuel from the pump 24 flow through the metering valve 28 into the metering chamber 62 for the next injection pulse and the metering piston 60 is moved upwardly by the return spring 66. The metering valve 28 and the timing valve 26 are closed by the electronic control unit after a predetermined metering time, corresponding to the desired quantity of fuel for the next pulse. The flow rate from pump 16 will be determined by engine speed and the next fuel injection pulse P will have a slope corresponding to pump flow rate and hence, engine speed. The absorption chamber 20 will be preset to an initial pressure for the next absorption pulse A according to engine speed, as described above. Hence, the absorption pulse will have a slope corresponding to engine speed and will be the inverse of the injection pulse P. Thus, if the same quantity of fuel is metered into the injector for each successive injection (for all engine cylinders), the engine will deliver constant torque even though the speed is varied.

The preferred embodiment of the invention has been described with reference to FIGS. 3 through 10; this embodiment of the invention is preferably implemented in a structural arrangement as shown in FIGS. 11 through 14 which include the components of FIG. 3 shown in structural form. A component in FIG. 11 which is the same as a component in FIG. 3 is designated by the same reference character having a prime symbol affixed thereto.

Figure 11:
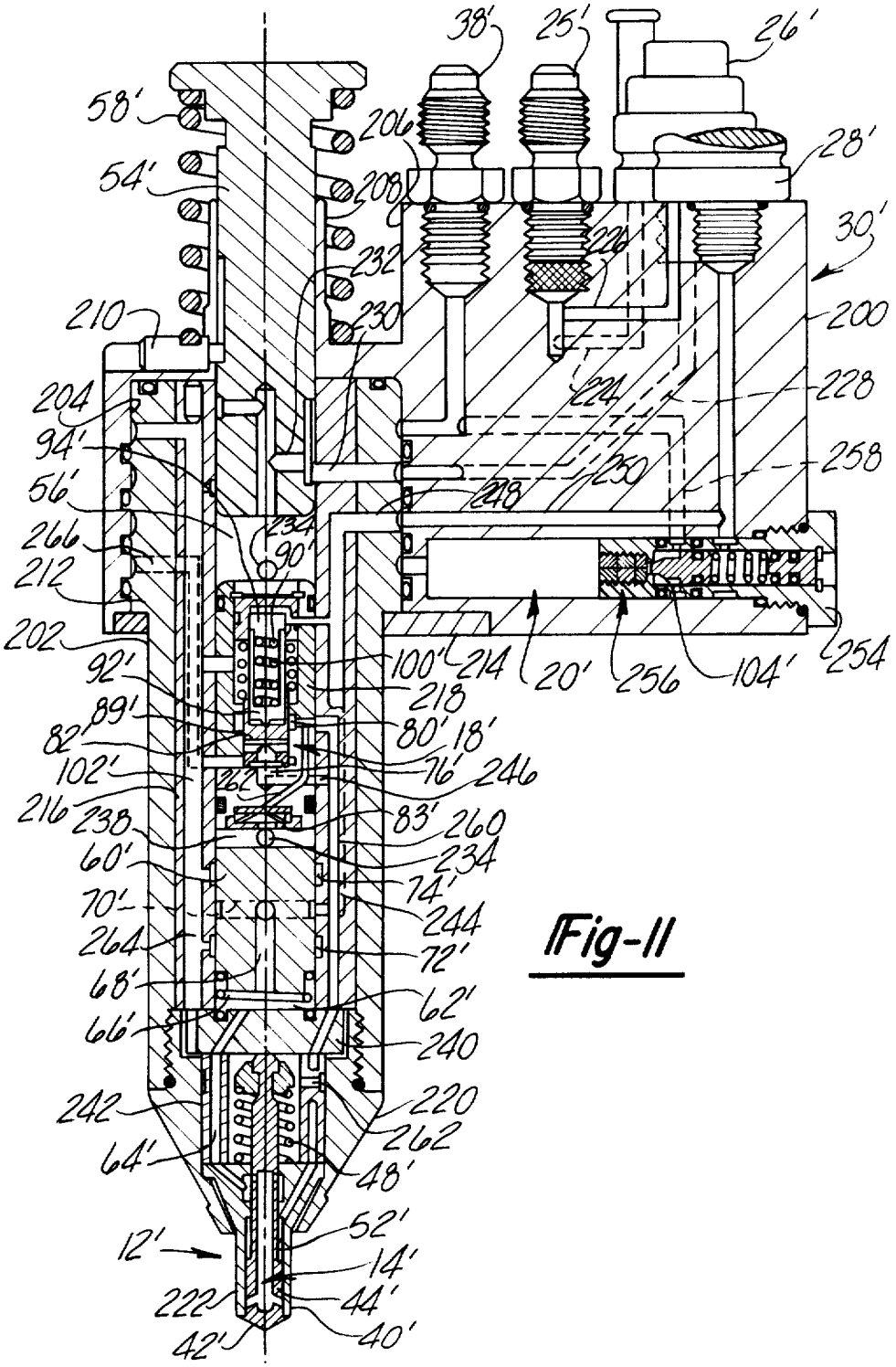
FIG. 11 shows the injector of this invention in a preferred embodiment.

In the injector as shown in FIG. 11, there is a coaxial arrangement of the pump piston 54', the pressure relief valve 18', the metering piston 60' and the poppet valve 12'. In this arrangement, the relief valve 18' is disposed between the pump piston 54' and the metering piston 60'. The pump chamber 56' is in communication with the upper end of the metering piston 60', by means to be described below. The metering chamber 62' communicates through a passage 64' with the pressure chamber 14'. The absorption chamber 20' is disposed laterally of the pump chamber and is in fluid communication with the relief valve 18' by means which will be described presently.

As shown in FIG. 11, the injector body 30' comprises an upper body portion 200 and, depending therefrom, a lower body portion 202. The upper body portion 200 is cylindrical in cross-section. A bore 204 is provided in the lower end of the body portion 200 to receive the lower body portion 202. The upper end of the body portion 200 is cut away to provide a recess 206 above the bore 204 and includes an integral sleeve 208 to receive the pump piston 54'. The pump piston is provided with a return spring 58' and is retained in the upper body portion 200 by a stop member 210.

The lower body portion 202 is of cylindrical cross-section and has an enlarged head 212 disposed within the bore 204 and is held in place by a lock-ring 214. The body portion 202 is provided with a cylindrical bore which receives a cylindrical liner 216 which is substantially coextensive with the lower body portion 202. The cylindrical liner 216 has a cylindrical bore which receives the pump piston 54', a fixed cylindrical body 218 for the relief valve 18' and the metering piston 60'. The cylindrical liner 216 also provides fluid passages as will be described presently. The lower body portion 202 is provided with an end cap 220 which is threadedly received in the body portion 202. The tip 222 of the poppet valve 14' is supported by the end cap 220.

The upper body portion 200 is provided with a supply conduit 25' which is adapted for connection with the outlet of the pump 24 (FIG. 3). A return conduit 38' is adapted for connection of the return conduit 36 to the fuel tank 22 (FIG. 3). The supply conduit extends into the body portion 200 through a passage 224 to the inlet of the timing valve 26' and to a passage 226 to the inlet of the metering valve 28'. The outlet of the timing valve 26' is connected through a passage 228 in the body portion 200 to a passage 230 in the head of the lower body portion 202 and then through a passage 232 in the pump piston 54' to the pump chamber 56'. The pump chamber 56' is connected through axial passages 234 and 236 (see FIGS. 12 and 13) to the upper end of the metering piston 60'.

As mentioned above, the piston body 218 which contains the relief valve 18' is disposed in the bore of the cylindrical liner 216 between the pump piston and the metering piston. The fuel flow from the pump chamber 56' bypasses the piston body 218 through the passages 234 and 236 and enters a chamber 238 between the upper end of the metering piston 60' and the lower end of the piston body 218. The fluid pressure delivered from the pump chamber 56' thus acts on the metering piston 60' against the bias spring 66'. The metering chamber 62 is connected with the pressure chamber 14' through a passage 64' extending through an adaptor plate 240, an adaptor sleeve 242 and the tip 222. The metering chamber 66' (and hence the pressure chamber 14') is connected to the relief valve inlet chamber 76' through a passage 68' in the metering piston 60' and thence through a passage 244 in the cylindrical linear 216 and a passage 246 in the piston body 218. The inlet chamber 76' of the relief valve (and hence the metering chamber 62') is connected through the passage 244 in the linear 216 and through a passage 248 in the head 212 and a passage 250 in the upper body portion 200 to the outlet of the metering valve 28'.

The relief valve 18' has a spool 82' disposed in a central bore in the piston body 218. The inlet chamber 76' of the relief valve is connected through the orifice 85' to a passage 89' which extends through the piston body 218 and the cylindrical liner 216 and the head 212 and a passage 252 to the inlet of the absorption chamber 20'. The absorption chamber 20' is formed by a lateral bore in the upper body portion 200 and a plug 254 extending into the bore and threadedly engaging the body portion 200. The outlet of the absorption chamber 20' extends through a flow restrictor including a series of three orifice elements 256 and a check valve 104'. The outlet of the check valve is connected to the return conduit 38' through a passage 258 in the body portion 200.

The relief valve inlet chamber 76' is also connected through an orifice 89' to the actuator chamber 52' for the poppet valve 12'. The orifice 89' is formed by a transverse passage in the valve spool 82' and an annular passage 80' in the piston body 218. The annular passage 80' is connected to the actuator chamber 52' through a passage 260 which extends through the cylindrical liner 216, the adaptor plate 240, the adaptor sleeve 242 and the tip 222. The annular passage 80' is also connected through a passage 262 in the piston body 218 to the inlet of a check valve 83' disposed in the lower end of the piston body. The outlet of the check valve communicates with the chamber 238 which receives the pump pressure. The relief valve spool 82 is biased toward the closed position by a bias spring 90' and by the fluid piston 92' in the cylinder 94'. The piston 92' is acted upon bias spring 100' and by fluid pressure from the inlet chamber 76' of the relief valve. For this purpose, the passage 244 in the cylindrical liner 216 is connected through a lateral passage 258 and a flow restrictor 260 to the cylinder 94'.

The poppet valve 12' has a seating element 40' formed on the tip 222 and a valve closure element 42' on the valve stem 44'. The valve stem is disposed within a bore in the tip and has a reduced diameter to form the actuator chamber 52'. The valve stem is provided with a return spring 48' within the adapter sleeve 242. The interior of the adapter sleeve is connected to the return conduit through a lateral passage 262 in the sleeve and thence through the region around the adapter plate 240 to an axial passage 264 in the liner 216. The passage 264 is connected through a lateral passage 266 in the head 212 to the return passage 258 in the body portion 200.

The metering piston 60' has a transverse passage 70' connected with the metering chamber 66' through an axial passage 68'. When the metering piston is in a lower position the transverse passage 70' is aligned with an annular passage 72' which is connected with the axial return passage 264, as shown in FIG. 14. Similarly, when the metering piston is in an upper position the transverse passage 70' is aligned with an annular passage 74' which is connected with the return passage 264. It is further noted that the space surrounding the piston 92' is connected through a passage 268 to the return passage 264.

The performance of the injector of this invention is represented graphically in FIGS. 15 and 16. The data for the graphs of these figures has been obtained by computer simulation, not by actual test results of an injector. The computer simulation was based upon the embodiment of the invention as described above with reference to FIGS. 3 and 11. The components of the simulated injector are as depicted except that the metering piston 60 has a passage 68 extending axially through the piston and includes a damper orifice and except that the flow restrictor 104 is a vortex diode. The design parameters used in the computer simulation are as follows:

| | | |
|---|---|---|
| Flow restrictor 98, area: | $A_0 = 0.00057$ | $in^2$ |
| Pump piston, 54, area: | $A_1 = 0.04909$ | $in^2$ |

-continued

| | | |
|---|---|---|
| Metering piston, 60, area: | $A_2 = 0.04909$ | $in^2$ |
| Actuator piston, 50, area: | $A_3 = 0.00189$ | $in^2$ |
| Pump 16, volume, (max.): | $V_1 = 0.20$ | $in^3$ |
| Volume under compression upstream of poppet valve 44: | $V_2 = 0.01893$ | $in^3$ |
| Actuator chamber, 52, volume: | $V_3 = 0.30$ | $in^3$ |
| Absorption chamber, 20, volume: | $V_4 = 0.2$ | $in^3$ |
| Metering piston, 60, mass: | $M_1 = 1 \times 10^{-7}$ | lb sec/$in^2$ |
| Poppet valve, 12, mass: | $M_2 = 6.81 \times 10^{-7}$ | lb sec/$in^2$ |
| Metering valve spring, 66, rate: | S = 100 | lb/in |
| Poppet valve spring, 48, rate; | K = 1200/600 | lb/in |
| Poppet valve, 12, diameter: | D = 0.04866 | in |
| Metering piston, 60, damper orifice conductance: | $G_2 = 0.166$ | $in^5$/lb sec |
| Metering piston, viscous drag: | G = 0.02 | lb sec/in |
| Poppet valve, 12, viscous drag: | R = 0 | lb sec/in |
| Fuel, fluid bulk modulus: | B = 250,000 | lb/$in^2$ |
| Poppet valve spring, 48, preload: | F = 0.399 lbs | lb |
| Cylinder, 100, volume: | $V_5 = 0.00602$ | $in^3$ |
| Piston, 92, area: | $A_5 = 0.04909$ | $in^2$ |
| Relief valve spool, 82, area: | $A_6 = 0.05511$ | $in^2$ |
| Spring, 90, rate: | KP = 1000 | lb/in |
| Flow restrictor, 104, (vortex diode) exit hole, area: | $A_7 = 5.6 \times 10^{-5}$ | $in^2$ |
| Flow restrictor, 104 (vortex diode) exit hole, diameter: | $D_7 = 0.0084$ | in |

FIG. 15 shows the simulated performance of the injector at a speed corresponding to engine speed of 2100 RPM. The relief valve is set to crack at a pressure of 13000 p.s.i. and has the following parameters:

$$\omega NS = 63{,}113 \text{ rad./sec.}$$

$$\alpha = 0.7$$

$$\alpha/\beta = 101$$

where:

$\omega NS$ is the natural frequency at neutral stability, $\alpha$ is a non-dimensional parameter that controls damping of the relief valve, and $\alpha/\beta$ is the gain margin.

In FIG. 15 various quantities are shown as a function of time or crankshaft angle, with the abscissa representing time. At the origin, at time 0 , the injection is commenced by closure of the timing valve 26. The start of injection occurs at a crankshaft angle $a_1$ and the end of injection corresponds with a crankshaft angle of $a_2$, as this notation was used in FIGS. 5 through 10. The curve 280 in FIG. 15 represents the fluid pressure in the pump chamber 56 which rises abruptly to a peak and then falls off to a fairly constant value. The curve 282 represents the fluid pressure in the pressure chamber 14 which also rises abruptly and after a brief transient becomes substantially constant. The curve 284 represents the injection or poppet valve opening area as a function of time and which is substantially linear. The curve 286 represents the flow rate of fuel through the poppet valve and is a ramp-shaped function of time, as desired. The curve 288 shows the orifice area of the relief valve orifice 89. FIG. 16 represents the injector performance at a speed corresponding to one-half that of FIG. 15. In this figure curve 290 represents pump prressure and curve 292 represents the pressure in chamber 14 at the poppet valve. The curve 294 represents the poppet valve orifice area and the curve 296 represents the flow rate through the poppet valve. Curve 298 shows the area of orifice 89 of the relief valve. It is noted that the curve 296 represents the fuel injection pulse and is ramp-shaped with a duration which is about twice as great and an amplitude which is about one-half as great as the corresponding curve 286 in FIG. 15.

A modification of the invention will now be described with reference to FIG. 17. This modification produces the desired ramp-shaped fuel pulses, as discussed with reference to FIG. 1. The pressure at the injection valve and the rate of movement of the valve are controlled in a manner similar to that described with reference to FIG. 3. As in the injector of FIG. 3, the pressure at the injection valve is maintained constant and the valve is opened at a velocity such that the product of velocity and the area of the valve orifice is a linear funcion of time. The area of the valve orifice increases linearly with displacement and the actuating means for the valve imparts opening motion to the valve at constant velocity. As in the injector of FIG. 3, an absorption chamber is used to accept an absorption pulse which is the inverse or complement of the injection pulse, i.e. to take up the excess flow from the pump. To provide for operation at variable speed, the ramp rate or slope and the amplitude of the absorption pulse are changed with speed to maintain the inverse relationship with the injection pulse. In this modification, the adjustment with speed is provided by adjustment of a flow restrictor, as by a variable orifice, connected with the adsorption chamber.

Figure 17:
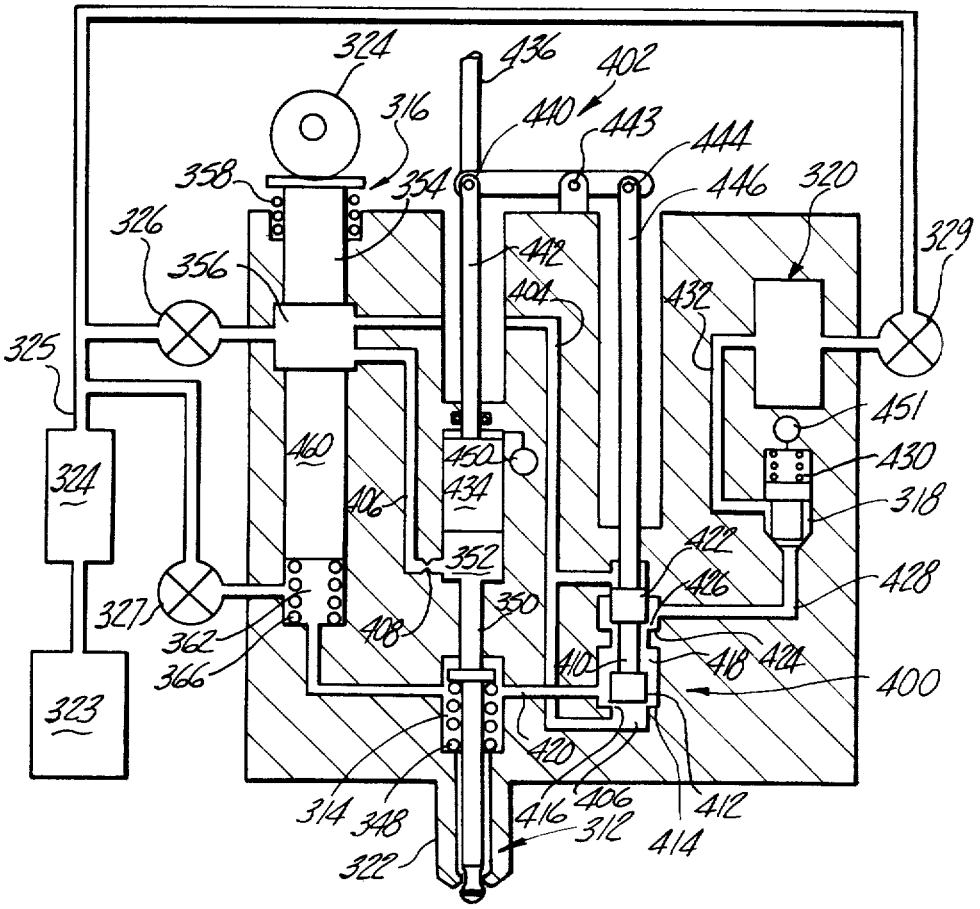
FIG. 17 shows a second embodiment of the invention.

Referring now to FIG. 17, there is shown a modified injector 402 having an injector body 330 provided with a nozzle 322. In general, the injector 310 comprises an injection or poppet valve 312 which is supplied with fuel from a pressure chamber 314. A high pressure pump 316 pressurizes the fuel in the chamber 314, causing fuel flow to a relief valve 318 and thence an absorption chamber 320. The injector 402 is supplied with fuel from a tank 323 by a transferpump 324. The outlet of the transfer pump 324 is connected through a supply conduit 325 and through a first solenoid timing valve 326 to the chamber 356 of the high pressure pump 316. The outlet of the transfer pump 324 is also connected through a second solenoid timing valve 327 to a metering chamber 362. The outlet of the pump 324 is also connected through a third timing valve 329 to the absorption chamber 320. The valve 329 is suitably controlled by the same solenoid as the valve 327, so that the valves open and close in unison. Additionally, the injector comprises a storage or actuator chamber 352 for pressure actuation of the poppet valve 312. It also comprises valve means 400 for controlling fluid flow from the pressure chamber 314 to the absorption chamber 320. The valve means 400 and the actuator chamber 352 are adjustable by speed responsive means 402.

The high pressure pump 316 comprises a piston 354 disposed in the pump chamber 356 and provided with a return spring 358. The pump is actuated by a constant lift cam 334 which is driven in synchronism with the engine crankshaft. The pump chamber 356 is connected through a passage 404 to an inlet chamber 406 of the valve means 400. The pump chamber 356 is also connected through a passage 406 and a flow restrictor 408 to the actuator chamber 352, which will be described in greater detail presently.

The valve means 400 comprises a valve spool 410 having a first valve land or closure element 412 coating with a first valve seat 414 to define a variable orifice 416 therebetween. The orifice 416 communicates with a valve chamber 418 which is connected through a passage 420 with the pressure chamber 314. The valve spool 410 also includes a valve closure element 422 which coacts with a valve seat 424 to define a flow restictor or variable orifice 426. The valve chamber 418 is in fluid communication through the orifice 426 and a passage 428 with the inlet of the relief valve 318. The relief valve 318 is provided with a bias spring 430 and is adapted to open at a predetermined value of pressure corresponding to the desired value of pressure in the chamber 314. The outlet of the relief valve 318 is connected through a passage 432 to the inlet of the absorption chamber 320. The outlet of the absorption chamber is connected through the timing valve 329 to the outlet of the transfer pump 325.

The storage or actuator chamber 352 is connected with the pump chamber through a flow restrictor 408. A piston 434 is the chamber 352 is movable by the speed responsive means 402 to adjust the volume of the chamber. A drain 450 above the piston 434 and a drain 451 at relief valve 318 are connected to a common drain line 452 which is connected to the outlet of the transfer pump 324.

The speed responsive means 402 comprises an input link 436 which constitutes the output element of an engine speed responsive device, such as a fly-weight governer. A control lever 438 is connected by a pivot pin 440 at one end thereof with the link 436. The lever 438 is mounted at a point intermediate its ends by a pivot pin 443 on the injector body 330. The lever 438 is connected by a first control arm 442 to the piston 434 for positional adjustment thereof. The other end of the control lever 438 is connected by a pivot pin 444 through a second control arm 446 to the valve spool 410 for positional adjustment thereof. The pivot pin 443 is located relative to the pivot pins 440 and 444 so that the displacement of the control arm 446 is one-half the displacement of control arm 442 is response to movement of the link 436.

A piston 460 is disposed between the pump chamber 356 and the metering chamber 362. The piston 460 serves to adjust the input impedance of the injector so that the impedance at the pump chamber 356 appears to be nearly constant and is resistive in nature. The constant input impedance will allow for locaton of the high pressure pump 316 at a remote location with connection of the chamber 356 and the pump through a long connecting line with minimum impedance mismatch and reflection. (The piston 460 can also be used as a metering device wherein the required amount of fuel is metered into the metering chamber 362 as in FIG. 3 or a piston stop means can be provided to limit the piston travel during injection. In the injector of FIG. 17, metering is accomplished by different means as will be described presently.)

In operation of the injector of FIG. 17, the solenoid valves 326, 327 and 329 are controlled by an electronic control unit of the fuel injection system. Preferably valve 326 is closed by spring force to provide fast closing and is opened by magnetic force. Valves 327 and 329 are actuated in unison and are preferably opened by a common spring and are closed by a common magnetic armature.

In operation, injection is initiated by closure of valve 326 (valves 327 and 329 having been closed previously) while the pump piston 354 is in its downward stroke. The flow from pump chamber 356 starts downward movement of piston 460 and it pressurizes the pressure chamber 314 through the passage 404, the adjustable orifice 416 and the passage 420. When the pressure in chamber 314 reaches a predetermined value of pressure corresponding to the setting of relief valve 318, the relief valve will open. The flow from the pump chamber 356, acting through the passage 406 and flow restrictor 408, causes the pressure in the actuator chamber 352 to increase, and the actuator piston 350 commences to move downwardly against the return spring 348 to open the poppet valve 312. The pressure in the pressure chamber 314 is maintained at a constant value, the poppet valve is opened at constant velocity and the orifice area of the poppet valve increases as a linear function of time to produce a ramp-shaped injection pulse. At the same time, fuel flow also leaves the pressure chamber 314 through the adjustable orifice 426 and the relief valve 318 and enters the absorption chamber 320. The orifice 426 and the absorption chamber 320 are sized so that the flow rate of the absorption pulse is the inverse of the injection pulse. The injection pulse is terminated by opening the valves 327 and 329 which immediately depressurizes the pressure chamber 314 and the poppet valve is quickly closed by the sprng 348. At the same time the absorption chamber 320 is depressurized and of course the relief valve 318 is closed. Now 326 is also open but is slower in response and the pump chamber 356 is depressurized. Fuel flows from the transfer pump 324 through the valve 327 into the metering chamber 362 and the piston 460 is moved upwardly under the influence of the return spring 366. Thus, the injector is prepared for the next injection cycle.

As the engine speed is increased, the pump 316 produces a higher flow rate and the injector operates to increase the slope and amplitude of the injection pulse and to produce an absorption pulse for the correspondingly increased slope and amplitude. This is accomplished by the adjustment of the volume of the actuator chamber 352 and the adjustment of the orifices 416 and 426 of the valve means 400. In particular, when the engine speed increases the volume of the actuator chamber 352 is decreased and the valve orifices are increased. The doubling of the engine speed causes the volume of the actuator chamber 352 to be reduced by a factor of 4 which causes the poppet valve velocity to be increased by a factor of 2. Doubling of engine speed also causes the orifice 416 and the orifice 426 to be increased by a factor of 2. This serves to change the flow resistance to the orifice 426 into the absorption chamber 320, changing the time constant thereof so that the absorption pulse is decreased in duration by a factor of 2 and increased in amplitude by a factor of 2. The action just described serves to reestablish a constant value of pressure in the pressure chamber 314 and an injection pulse of twice the amplitude and one-half the duration is produced.

Figure 18:
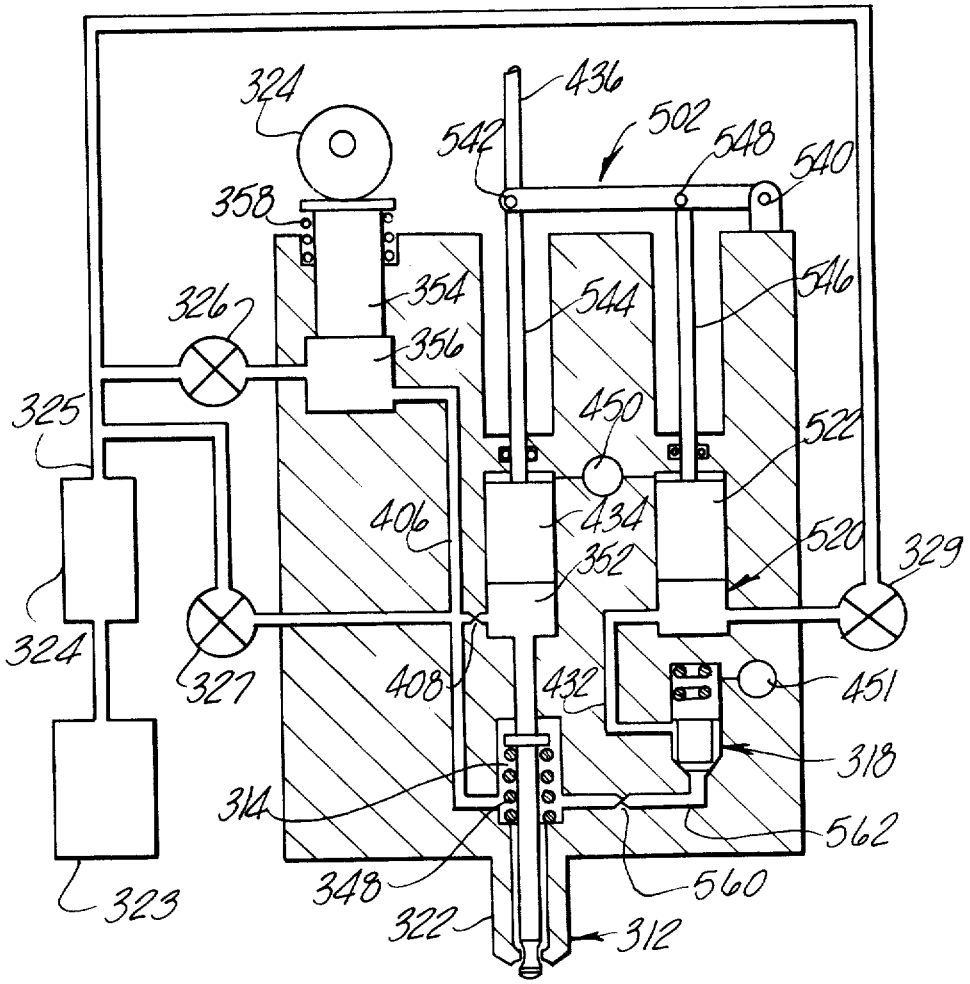
FIG. 18 shows a third embodiment of the invention.

A further modification of the invention is shown in FIG. 18. This modification is similar to that shown in FIG. 17 except that the valve means is eliminated and the absorption chamber 520 is provided with an adjustable volume. (Although it is optional in this modification, the piston 460 of FIG. 17 is eliminated.) Since the modification of FIG. 18 is similar to that of FIG. 17, like components are designated by like reference characters. As shown in FIG. 18, this modification includes an absorption chamber 520 which includes a movable piston 522. The piston 522 is adjustably positioned in the chamber 520 in accordance with changes in engine speed. The speed responsive means 502 includes a link 436 which is the output member of a speed responsive device driven by the engine, such as a fly-weight governer. A control lever 538 is pivotally mounted at one end by a pivot pin 540 on the injector body 330. At the other end the control lever 538 is connected by a pivot pin 542 to the link 436. A first control arm 544 is connected at its upper end with the pivot pin 542 and at its lower end it is connected with the adjustable piston 434 in the actuator chamber 352. A second control arm 546 is connected at its upper end with the control lever 538 by a pivot pin 548. The control arm 546 is connected at its lower end with the adjustable piston 522 in the absorption chamber 520. The pivot pin 548 and the pivot pin 542 are spaced from a pivot pin 540 so that an increase in speed causes both the absorption chamber and the actuator chamber to be decreased in size. In particular, if the speed is doubled the volume of the actuator chamber 352 is reduced by a factor of 4 and the volume of the absorption chamber is reduced by a factor of 2. A flow restrictor 560 is connected in the passage 562 between the pressure chamber 314 and the relief valve 318.

The operation of the modification of FIG. 18 is similar in principle to that of the injector of FIG. 17 except for the variable speed adjustment. In FIG. 18, the fixed flow restrictor 562 coacts with the variable volume of the absorption chamber 520 to establish the time constant thereof so that the absorption pulse remains the inverse of the injection pulse over the operating speed range.

Although the description of this invention has been given with respect to a particular embodiment, it is not to be construed in a limiting sense. Many variations and modifications will now occur to those skilled in the art.

What is claimed is:

1. A fuel injector for an internal combustion engine comprising:

a pressure chamber for receiving fuel at a predetermined flow rate;

injection valve means communicating with said pressure chamber and having a valve means situated therein for opening said chamber in response to the pressure therein and for delivering an injection fuel pulse to a combustion chamber of said engine; and negative pressure feedback regulator means for establishing the pressure within said pressure chamber at a substantially constant value prior to fuel injection and for maintaining the pressure therein at said value during injection and for regulating the opening velocity of said valve to be substantially linear.

2. The injector as defined in claim 1 wherein said regulator means includes absorbing means having an absorption chamber for absorbing a fluid pulse.

3. The invention as defined in claim 2 wherein the absorbing means includes a flow restrictor connected between the pressure chamber and the absorption chamber.

4. The invention as defined in claim 3 including means connected with said absorbing means for changing its time constant as a function of speed of operation of the injector.

5. The injector as defined in claim 4 wherein said regulator means includes a relief valve connected between said pressure chamber and said absorption chamber.

6. The invention as defined in claim 5 wherein said means connected with the absorbing means is a time constant discharge means connected with the absorption chamber.

7. The invention as defined in claim 5 wherein said means connected with the absorbing means is means for changing the volume of said absorption chamber.

8. The invention as defined in claim 5 wherein said means connected with said absorbing means is means for changing the conductance of said flow restrictor.

9. The invention as defined in claim 6, 7 or 8 including means for opening said injection valve so that its metering orifice area increases as a linear function of time, means including said relief valve for maintaining a substantially constant pressure in the pressure chamber whereby said injection valve produces a ramp-shaped fuel injection pulse.

10. The invention as defined in claim 9 wherein predetermined flow rate into the pressure chamber is a constant value for a given speed of operation and increases with engine speed whereby said fuel injection pulse has a slope and amplitude which increase with speed of operation.

11. The invention as defined in claim 10 wherein the means for opening the injection valve includes means for opening the valve at constant velocity, the area of the metering orifice of said valve increasing linearly with displacement.

12. A fuel injector for an internal combustion engine comprising, a pressure chamber for receiving fuel, an injection valve communicating with said pressure chamber and adapted to deliver a pulse of fuel to a combustion chamber of said engine, said valve including a valve seat element and a valve closure element providing a metering orifice with an area which increases as a predetermined function of displacement of the closure element from the seat element, means for maintaining substantially constant pressure in said pressure chamber, and means for actuating said valve closure element at a controlled velocity, the product of said area and said velocity being a substantially linear function of time, whereby the flow rate of fuel through said injection valve increases linearly with time.

13. The invention as defined in claim 12 wherein said means for actuating includes means for opening said valve closure element at a constant velocity.

14. The invention as defined in claim 13 wherein said means for actuating comprises a bias spring urging said closure element toward a closed position and a piston acting on said closure element and urging it toward an open position, and means for applying controlled pressure to said piston.

15. The invention as defined in claim 14 wherein said means for applying comprises a pressure control valve disposed between said pressure chamber and said piston.

16. A fuel injector for an internal combustion engine comprising:

a pressure chamber for receiving fuel;

an injection valve communicating with said pressure chamber and adapted to deliver a pulse of fuel to a combustion chamber of said engine; said valve including a valve seat element and a valve closure element providing a metering orifice with an area which increases as a predetermined function of displacement of the closure element from the seat element;

means for maintaining substantially constant pressure in said pressure chamber;

means for actuating said valve closure element at a controlled velocity the product of said area and said velocity being a stantially linear function of time, whereby the flow rate of fuel through said injection valve increases linearly with time;

a high pressure pump including a pump chamber for receiving fuel at relatively low pressure, said pump chamber being operatively connected with said pressure chamber, said high pressure pump being adapted to produce a substantially constant flow rate into said pressure chamber throughout a pump cycle, a relief valve connected with said pressure chamber and adapted to open at a predetermined valve of fuel pressure described at said orifice for fuel injection, and flow control means connected with said relief valve for exhausting fuel from said pressure chamber at a flow rate which decreases linearly with time as an inverse function of the flow rate through said injection valve.

17. The invention as defined in claim 16 wherein said flow control means comprises an absorption chamber.

18. The invention as defined in claim 17 wherein said high pressure pump is a piston pump, a metering chamber, and a metering piston connected between said pump chamber and said metering chamber.

19. The invention as defined in claim 18 wherein said metering piston includes a restricted passage extending between the pump chamber and the metering chamber, and a bias spring urging said metering piston towards said pump chamber.

20. The invention as defined in claim 17 including a low pressure pump adapted to be connected with a fuel source, a first conduit means connecting the outlet of said low pressure pump with said pressure chamber, a metering valve in said first conduit means for controlling the quantity of fuel admitted to the pressure chamber for each injection cycle, second conduit means connected between the outlet of said low pressure pump and said pump chamber and a timing valve in said second conduit means for isolating said pumps during injection.

21. A fuel injector for a variable speed internal combustion engine, said injector being adapted to produce successive fuel injection pulses having a ramp flow rate having a slope and amplitude which increase with engine speed, said injector comprising, a pressure chamber for receiving fuel at a flow rate which varies directly with engine speed, an injection valve in fluid communication with said pressure chamber and adapted to deliver a pulse of fuel to a combustion chamber of said engine, said valve including a valve seat element and a valve closure element providing a metering orifice with an area which increases as a predetermined function of displacement of the closure element relative to that seat element, and means for opening said valve closure element at a controlled velocity, the product of said area and said velocity being a substantially linear function of time, means for absorbing a fluid pulse in fluid communication with said pressure chamber, means for maintaining the pressure in said pressure chamber at a substantially constant value whereby the flow rate of fuel through said injection valve is a linear function of time having a slope which increases with engine speed, and means for presetting the flow rate into said means for absorbing for each injection cycle so that it is substantially an inverse function of the flow rate of fuel through said injection valve.

22. The invention as defined in claim 21 wherein said means for presetting comprises means for changing the time constant of the means for absorbing.

23. The invention as defined in claim 21 wherein said means for presetting comprises a discharge passage connected with said absorption chamber, and a flow restrictor in said discharge passage whereby the value of pressure in the absorption chamber at the beginning of each injection cycle depends upon the time interval between cycle and hence, varies with engine speed.

24. The invention as defined in claim 21 wherein said means for maintaining is a relief valve connected with the pressure chamber, a bias spring urging the relief valve closed and a bias piston for urging the relief valve closed, and a flow restrictor connecting said pressure chamber with said bias piston, the effective area of said relief valve being larger than the effective area of said bias piston, whereby said relief valve has a fast response and a high value of gain.

25. The invention as defined in claim 21 wherein said means for absorbing includes an absorption chamber.

26. The invention as defined in claim 25 wherein said means for absorbing includes a flow restrictor connected between the pressure chamber and the absorption chamber.

27. The invention as defined in claim 25 including a pump connected with the pressure chamber and producing a fuel flow rate which varies with engine speed, and wherein said absorption chamber is of constant volume, the means for presetting the flow rate into said absorption chamber comprises an adjustable flow restrictor connected between said pressure chamber and said absorption chamber, engine speed responsive means connected with said flow restrictor for adjusting the conductance thereof, and wherein said means for opening includes an actuator piston, an actuator chamber in fluid communication with said actuator piston, a passage connected between said pump and said actuator chamber, means for varying the volume of said actuator chamber, said speed responsive means connected with said varying means to vary the volume of said actuator chamber as a function of engine speed, whereby said valve closure element is opened at different values of constant velocity for different engine speeds.

28. The invention as defined in claim 27 wherein said means for maintaining includes a relief valve connected with said pressure chamber through said flow restrictor and is adapted to open at a predetermined value of fuel pressure.

29. The invention as defined in claim 27 including a flow restrictor in said passage between said pump and said actuator chamber.

30. The invention as defined in claim 27 wherein said high pressure pump is a piston pump, a metering chamber connected with said pressure chamber, and a piston disposed between said pump chamber and said metering chamber for determining the volume of flow into said pressure chamber for each stroke of the piston pump.

31. The invention as defined in claim 29 including a flow control valve connected between said pump and said pressure chamber, said speed responsive means being connected with the flow control valve for adjusting the opening thereof.

32. The invention as defined in claim 25 including means for varying the volume of said absorption chamber in accordance with changes of engine speed, said means for opening including an actuator piston, a storage chamber in fluid communication with said actuator piston, and means for varying the volume of said storage chamber in accordance with engine speed.

33. The invention as defined in claim 32 including a pump connected with the pressure chamber and producing a fuel flow rate which varies with engine speed, a second flow restrictor, said pump being connected with said storage chamber through said second flow restrictor.

34. The invention as defined in claim 33 wherein said maintaining means includes a relief valve connected between said pressure chamber and said absorption chamber.

35. The invention as defined in claim 21 wherein said means for opening includes means for actuating said valve closure element at a constant velocity.

36. The invention as defined in claim 35 wherein said means for actuating comprises a bias spring urging said closure element toward a closed position and an actuating piston acting on said closure element and urging it toward an open position, and means for controlling the pressure applied to said actuating piston.

37. A fuel injector for a variable speed internal combustion engine, said injector being adapted to produce successive fuel injection pulses having a ramp flow rate having a slope and amplitude which increase with engine speed, said injector comprising:

a pressure chamber for receiving fuel at a flow rate which varies directly with engine speed;

an injection valve in fluid communication with said pressure chamber and adapted to deliver a pulse of fuel to a combustion chamber of said engine; said injection valve including a valve seat element and a valve closure element providing a metering orifice with an area which increases as a predetermined function of displacement of the closure element relative to the seat element;

means for actuating said valve closure element at a controlled velocity including a bias spring urging said closure element toward a closed position and an actuating piston acting on said closure element and urging it toward an open position, and means for controlling the pressure applied to said actuating piston, the product of said area and said velocity being a substantially linear function of time;

means for absorbing a fluid pulse in fluid communication with said pressure chamber;

means for maintaining the pressure in said pressure chamber at a substantially constant value whereby the flow rate of fuel through said injection valve is a linear function of time having a slope which increases with engine speed;

means for presetting the flow rate into said means for absorbing for each injection cycle so that it is substantially an inverse function of the flow rate of fuel through said injection valve, wherein said relief valve comprises a valve spool movably disposed in a valve body, said valve body having a relief valve port connected with said absorption chamber, and wherein said means for controlling comprises said valve spool and valve body, a passage in said spool, and an outlet port in said body, said outlet port being connected with said actuating piston.

38. The invention as defined in claim 36 including a high pressure pump including a pump chamber for receiving fuel at relatively low pressure, said pump chamber being operatively connected with said pressure chamber, said high pressure pump being adapted to produce a substantially constant flow rate into said pressure chamber throughout a pump cycle.

39. A fuel injector for a variable speed internal combustion engine, said injector being adapted to produce successive fuel injection pulses having a ramp flow rate having a slope and amplitude which increase with engine speed, said injector comprising:

a pressure chamber for receiving fuel at a flow rate which varies directly with engine speed;

an injection valve in fluid communication with said pressure chamber and adapted to deliver a pulse of fuel to a combustion chamber of said engine; said injection valve including a valve seat element and a valve closure element providing a metering orifice with an area which increases as a predetermined function of displacement of the closure element relative to the seat element;

means for actuating said valve closure element at a controlled velocity including a bias spring urging said closure element toward a closed position and an actuating piston acting on said closure element and urging it toward an open position, and means for controlling the pressure applied to said actuating piston, the product of said area and said velocity being aubstatially linear function of time;

means for absorbing a fluid pulse in fluid communication with said pressure chamber;

means for maintaining the pressure in said pressure chamber at a substantially constant value whereby the flow rate of fuel through said injection valve is a linear function of time having a slope which increases with engine speed;

means for presetting the flow rate into said means for absorbing for each injection cycle so that it is substantially an inverse function of the flow rate of fuel through said injection valve, a metering chamber connected with said pressure chamber, and said metering chamber.

40. The invention as defined in claim 39 wherein said metering piston includes a restricted passage extending between the pump chamber and the metering chamber, and a bias spring urging said metering piston toward said pump chamber.

41. The invention as defined in claim 40 including a low pressure pump adapted to be connected with a fuel source, a first conduit connecting the outlet of said low pressure pump with said metering chamber, a metering valve in said first conduit means for controlling the quantity of fuel admitted to the metering chamber for each injection cycle, a second conduit connected between the outlet of said low pressure pump and said pump chamber, and a timing valve in said second conduit means for isolating said pumps during injection.

42. A fuel injector for an internal combustion engine comprising:

a pressure chamber for receiving fuel at a constant flow rate for a given engine speed wherein said flow rate varies in proportion with engine speed;

an injection valve having a metering orifice, communicating with said pressure chamber and having means for opening said metering orifice in response to pressure applied thereto and for delivering an injected fuel pulse to a combustion chamber of said engine; wherein said fuel pulse is ramped shaped having a slope and amplitude which varies in proportion to engine speed;

absorbing means in fluid communication with said pressure chamber for absorbing a fluid pulse and a time variable flow rate of fuel out of said pressure chamber and for modifying the time rate of change of flow through said injection valve, wherein said absorbing means includes an absorption chamber and further includes a flow restrictor connected between said pressure chamber and the absorption chamber;

first means including a relief valve connected with said absorbing means and said pressure chamber for changing the time constant of said absorbing means as a function of engine speed wherein said first means includes time constant discharge means connected with said absorption chamber;

second means for opening said injection valve so that its metering orifice area increases as a linear function of time; and third means including said relief valve for maintaining a substantially constant pressure in said pressure chamber.

43. A fuel injector for an internal combustion engine comprising:

a pressure chamber for receiving fuel at a constant flow rate for a given speed of operation wherein said flow rate varies in proportion with engine speed;

an injection valve having a metering orifice communicating with said pressure chamber and having means for opening said metering orifice in response to pressure applied thereto and for delivering an injection fuel pulse to a combustion chamber of said engine; wherein said fuel pulse is saw tooth shaped having a slope and amplitude which varies in proportion to engine speed;

absorbing means in fluid communication with said pressure chamber for absorbing a fluid pulse and for absorbing a time variable flow rate of fuel out of said pressure chamber and for modifying the time rate of change of flow through said injection valve, wherein said absorbing means includes an absorption chamber and further includes a flow restrictor connected between said pressure chamber and the absorption chamber;

first means including a relief valve connected with said absorbing means and said pressure chamber for changing the time constant of said absorbing means as a function of speed of operation of the injector; wherein said first means includes means for changing the volume of said absorption chamber;

second means for opening said injection valve so that its metering orifice area increases as a linear function of time; and third means including said relief valve for maintaining a substantially constant pressure in said pressure chamber.

44. A fuel injector for an external combustion engine comprising;

a pressure chamber for receiving fuel at a constant flow rate for a given speed of operation wherein said flow rate varies in proportion with engine speed;

an injection valve having a metering orifice communicating with said pressure chamber and having means for opening said metering orifice in response to pressure applied thereto and for delivering an injection fuel pulse to a combustion chamber of said engine; wherein said fuel pulse is saw tooth shaped having a slope and amplitude which increases with speed of operation;

absorbing means in fluid communication with said pressure chamber for absorbing a fluid pulse and for absorbing a time variable flow rate of fuel out of said pressure chamber for modifying the time rate of change of flow through said injection valve, wherein said absorbing means includes an absorption chamber and further includes a flow restrictor connected between said pressure chamber and the absorption chamber;

first means including a relief valve connected with said absorbing means and said pressure chamber changing the time constant of said absorbing means as a function of speed of operation of the injector; wherein said first means includes means for changing the conductance of said flow restrictor;

second means for opening said injection valve so that its metering orifice area increases as a linear function of time; and third means including said relief valve for maintaining a substantially constant pressure in said pressure chamber.

* * * * *